US010830083B2

(12) United States Patent
Zhang et al.

(10) Patent No.: US 10,830,083 B2
(45) Date of Patent: Nov. 10, 2020

(54) GAS TURBINE ENGINE WITH A TURBINE BLADE TIP CLEARANCE CONTROL SYSTEM

(71) Applicant: Siemens Energy, Inc., Orlando, FL (US)

(72) Inventors: Jiping Zhang, Winter Springs, FL (US); Barton M. Pepperman, Winter Springs, FL (US)

(73) Assignee: SIEMENS ENERGY, INC., Orlando, FL (US)

( * ) Notice: Subject to any disclaimer, the term of this patent is extended or adjusted under 35 U.S.C. 154(b) by 236 days.

(21) Appl. No.: 15/515,169

(22) PCT Filed: Oct. 23, 2014

(86) PCT No.: PCT/US2014/061902
§ 371 (c)(1),
(2) Date: Mar. 29, 2017

(87) PCT Pub. No.: WO2016/064393
PCT Pub. Date: Apr. 28, 2016

(65) Prior Publication Data

US 2017/0218788 A1 Aug. 3, 2017

(51) Int. Cl.
*F01D 11/18* (2006.01)
*F01D 11/08* (2006.01)
*F01D 11/16* (2006.01)

(52) U.S. Cl.
CPC ..... *F01D 11/18* (2013.01); *F01D 11/08* (2013.01); *F01D 11/16* (2013.01);
(Continued)

(58) Field of Classification Search
CPC ..... F05D 2240/11; F01D 11/18; F01D 11/20; F01D 11/24; F01D 11/08
See application file for complete search history.

(56) References Cited

U.S. PATENT DOCUMENTS 2,863,634 A * 12/1958 Chamberlin ..... F01D 9/042 415/134
3,807,891 A 4/1974 McDow et al.
(Continued)

FOREIGN PATENT DOCUMENTS

CN 101493018 A 7/2009
CN 101539035 A 9/2009
JP 11062510 A 3/1999

OTHER PUBLICATIONS

PCT International Search Report and Written Opinion dated Jun. 29, 2015 corresponding to PCT Application PCT/US2014/061902 filed Oct. 23, 2014.

*Primary Examiner* — Kenneth J Hansen

(57) ABSTRACT

A gas turbine engine having a turbine blade tip clearance control system for increasing the efficiency of the engine by reducing the gap between turbine blade tips and radially outward ring segments is disclosed. The turbine blade tip clearance control system may include one or more clearance control bands positioned radially outward of inner surfaces of ring segments and bearing against at least one outer surface of the ring segments to limit radial movement of the ring segments. During operation, the clearance control band limits radial movement of the ring segments, and the turbine blade tips do not have a pinch point during start-up transient conditions. In addition, the smallest gap during turbine engine operation may be found at steady state operation of the gas turbine engine. Thus, the clearance control system can set the gap between turbine blade tips and ring segments to be zero at steady state operation.

8 Claims, 7 Drawing Sheets

(52) U.S. Cl.
CPC ..... *F05D 2240/11* (2013.01); *F05D 2260/38* (2013.01); *F05D 2300/50212* (2013.01)

(56) References Cited

U.S. PATENT DOCUMENTS 5,080,557 A * 1/1992 Berger ..... F01D 11/08 277/411
5,203,673 A 4/1993 Evans
6,048,170 A * 4/2000 Dodd ..... F01D 11/005 415/135
6,142,731 A 11/2000 Dewis et al.
6,758,653 B2 7/2004 Morrison
6,926,495 B2 8/2005 Diakunchak
6,968,696 B2 11/2005 Little
7,086,233 B2 8/2006 Chehab et al.
7,096,673 B2 8/2006 Little et al.
7,708,518 B2 5/2010 Chehab
7,785,063 B2 8/2010 McQuiggan et al.
8,485,785 B2 7/2013 Garner et al.
8,684,669 B2 4/2014 Chehab et al.
2004/0071548 A1* 4/2004 Wilson, Jr. ..... F01D 11/18 415/173.1
2005/0031446 A1* 2/2005 Ress, Jr. ..... F01D 11/025 415/173.2
2005/0050901 A1 3/2005 Little
2005/0058539 A1 3/2005 Diakunchak
2005/0076649 A1 4/2005 Little et al.
2005/0109039 A1 5/2005 Chehab et al.
2007/0003410 A1 1/2007 Chehab
2009/0022594 A1* 1/2009 Garner ..... F01D 5/22 416/221
2010/0162722 A1 7/2010 McQuiggan et al.
2012/0207586 A1* 8/2012 Chehab ..... F01D 11/122 415/118
2013/0149123 A1 6/2013 Laurello

* cited by examiner

GAS TURBINE ENGINE WITH A TURBINE BLADE TIP CLEARANCE CONTROL SYSTEM

FIELD OF THE INVENTION

This invention is directed generally to turbine engines, and more particularly to systems for reducing gaps between turbine airfoil tips and radially adjacent components, such as, ring segments, in turbine engines so as to improve turbine engine efficiency by reducing leakage.

BACKGROUND

Turbine engines commonly operate at efficiencies less than the theoretical maximum because, among other things, losses occur in the flow path as hot compressed gas travels down the length of the turbine engine. One example of a flow path loss is the leakage of hot combustion gases across the tips of the turbine blades where work is not exerted on the turbine blade. This leakage occurs across a space between the tips of the rotating turbine blades and the surrounding stationary structure, such as ring segments that form a ring seal. This spacing is often referred to as the blade tip clearance.

Blade tip clearances cannot be eliminated because, during transient conditions such as during engine startup or part load operation, the rotating parts (blades, rotor, and discs) and stationary parts (outer casing, blade rings, and ring segments) thermally expand at different rates. As a result, blade tip clearances can actually decrease during engine startup until steady state operation is achieved at which point the clearances can increase, thereby reducing the efficiency of the engine. Thus, a need exists to reduce the likelihood of turbine blade tip rub and reduce this undesirably large blade tip clearance.

SUMMARY OF THE INVENTION

A gas turbine engine having a turbine blade tip clearance control system for increasing the efficiency of the turbine engine by reducing the gap between turbine blade tips and radially outward ring segments is disclosed. The turbine blade tip clearance control system may include one or more clearance control bands positioned radially outward of inner surfaces of ring segments and bearing against at least one outer surface of the ring segments to limit radial movement of the ring segments. During operation, the clearance control band limits radial movement of the ring segments and does not have a pinch point during start-up transient conditions. In addition, the smallest gap during turbine engine operation is found at steady state operation of the gas turbine engine. Thus, the clearance control band of the clearance control system can be configured to set the gap between turbine blade tips and radially outward ring segments at steady state operation to zero to substantially eliminate, if not complete eliminate, leakage of hot combustion gases through the gap via the elimination of the gap.

In at least one embodiment, the gas turbine engine may be formed from a turbine assembly formed from a rotor assembly having one or more turbine blades formed from a generally elongated airfoil having a leading edge, a trailing edge, a pressure side, a suction side, a tip at a first end and a platform coupled to a second end of the generally elongated airfoil opposite to the first end. A plurality of ring segments may be positioned radially outward from the tip of the turbine blade. The plurality of ring segments may be aligned in a circumferentially extending row and may form a ring around a travel path of the at least one turbine blade. Each of the ring segments may include an inner surface forming a portion of a hot gas path within the turbine assembly. One or more clearance control bands may be positioned radially outward of the inner surfaces of the ring segments and may bear against one or more outer surfaces of the ring segments to limit radial movement of the ring segments. The clearance control band may form a ring radially outward of the inner surfaces of the ring segments. In at least one embodiment, the clearance control band may have a lower coefficient of thermal expansion than a material forming one or more ring segments.

One or more of the ring segments may include an upstream bearing surface and a downstream bearing surface configured to engage the clearance control band. The ring segments may include a first upstream receiver channel positioned on an upstream aspect of the ring segment and may include a first downstream receiver channel positioned on a downstream aspect of the ring segment. An upstream edge of the clearance control band may be contained within the first upstream receiver channel, and a downstream edge of the clearance control band may be contained within the first downstream receiver channel. The first upstream receiver channel may be formed from an upstream bearing surface and an upstream outer containment surface. The first downstream receiver channel may be formed from a downstream bearing surface and a downstream outer containment surface. One or more upstream support arms may extend radially outward from the ring segment, and one or more downstream support arms may extend radially outward from the ring segment. The upstream support arm may house the first upstream receiver channel, and the downstream support arm may house the first downstream receiver channel.

In at least one embodiment, the clearance control band may be formed from an upper half and a lower half. The upper and lower halves of the clearance control band may be coupled together at a first intersection at a first horizontally positioned joint and may be coupled together at a second intersection at a second horizontally positioned joint. Either of the first and second joints, or both, may be coupled together via one or more locking pins extending through an orifice in a first joint connection block and an orifice in a second joint connection block.

The clearance control system may also include a movement limiter extending radially outward from the clearance control band. The movement limiter may be formed from one or more pins extending radially outward from the clearance control band, whereby a head of the pin has a larger cross-sectional area and is positioned radially outward from a body of the pin and is secured by a bearing surface on an adjacent turbine component. In at least one embodiment, the movement limiter may include an upper movement limiter to secure an upper half the at least one clearance control band and a lower movement limiter to secure a lower half the at least one clearance control band.

During use, the turbine may be brought from through a start-up transient conditions to steady state operation. During operation, the clearance control band limits radial movement of the ring segments and does not have a pinch point where the gap is the smallest at a point during start-up transient conditions. Instead, the smallest gap occurs during steady state operating conditions. In at least one embodiment, the clearance control band of the clearance control system can be configured to set the gap between turbine blade tips and radially outward ring segments at steady state operation to zero to substantially eliminate, if not complete eliminate, leakage of hot combustion gases through the gap via the elimination of the gap. Eliminating the leakage of hot combustion gases through the gap increases the efficiency of the turbine assembly and the gas turbine engine.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
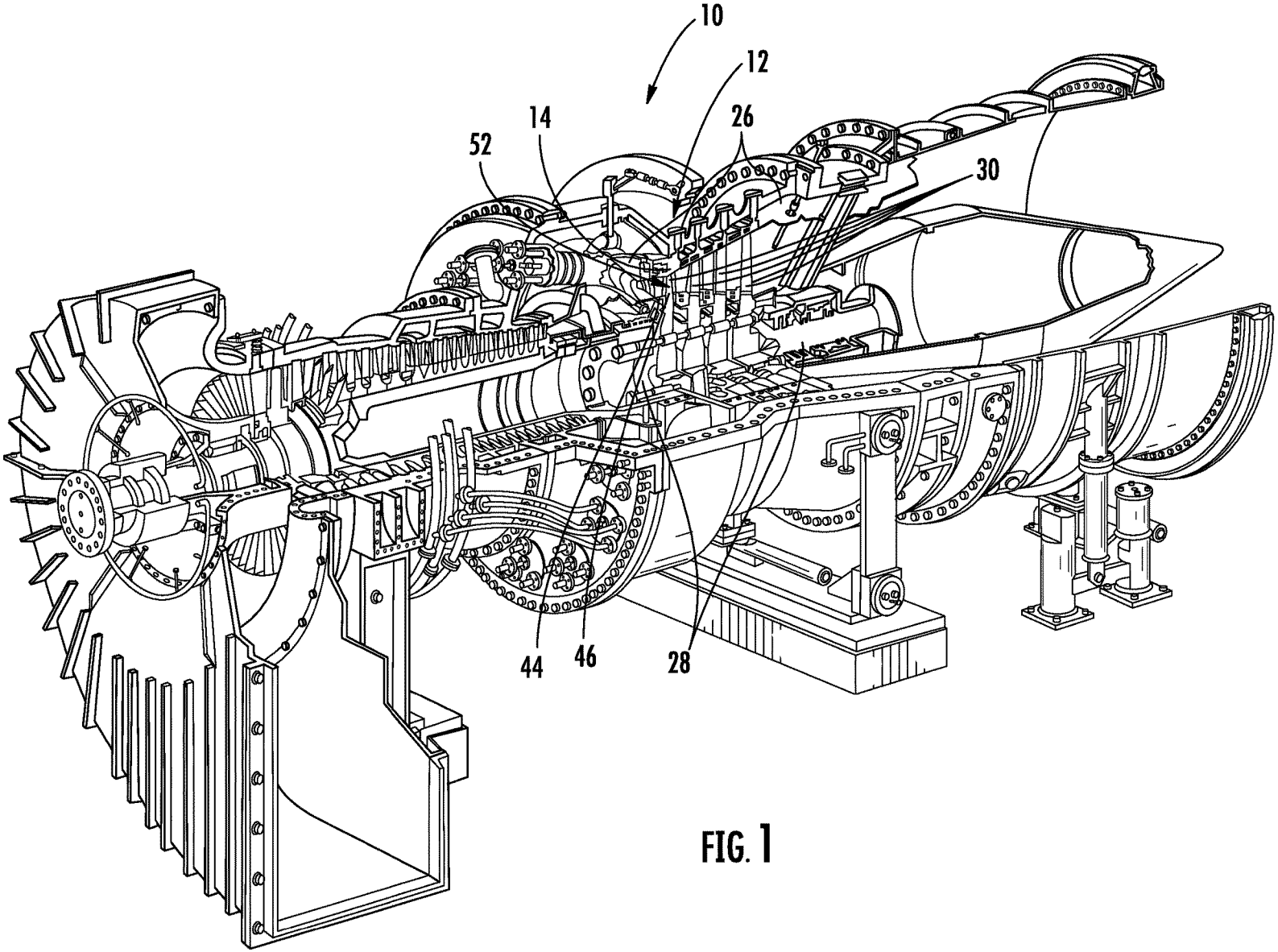
FIG. 1 is a cross-sectional, perspective view of a gas turbine engine with the a turbine blade tip clearance control system.

As shown in FIGS. 1-13, a gas turbine engine 10 having a turbine blade tip clearance control system 12 for increasing the efficiency of the turbine engine 10 by reducing the gap 14 between turbine blade tips 16 and radially outward ring segments 18 is disclosed. The turbine blade tip clearance control system 12 may include one or more clearance control bands 20 positioned radially outward of inner surfaces 22 of ring segments 18 and bearing against at least one outer surface 24 of the ring segments 18 to limit radial movement of the ring segments 18. During operation, the clearance control band 20 limits radial movement of the ring segments 18 and does not have a pinch point during start-up transient conditions. In addition, the smallest gap 14 during turbine engine operation is found at steady state operation of the gas turbine engine 10, as shown in FIG. 13. Thus, the clearance control band 20 of the clearance control system 12 can be configured to set the gap 14 between turbine blade tips 16 and radially outward ring segments 18 at steady state operation to zero to substantially eliminate, if not complete eliminate, leakage of hot combustion gases through the gap 14 via the elimination of the gap 14.

Figure 4:
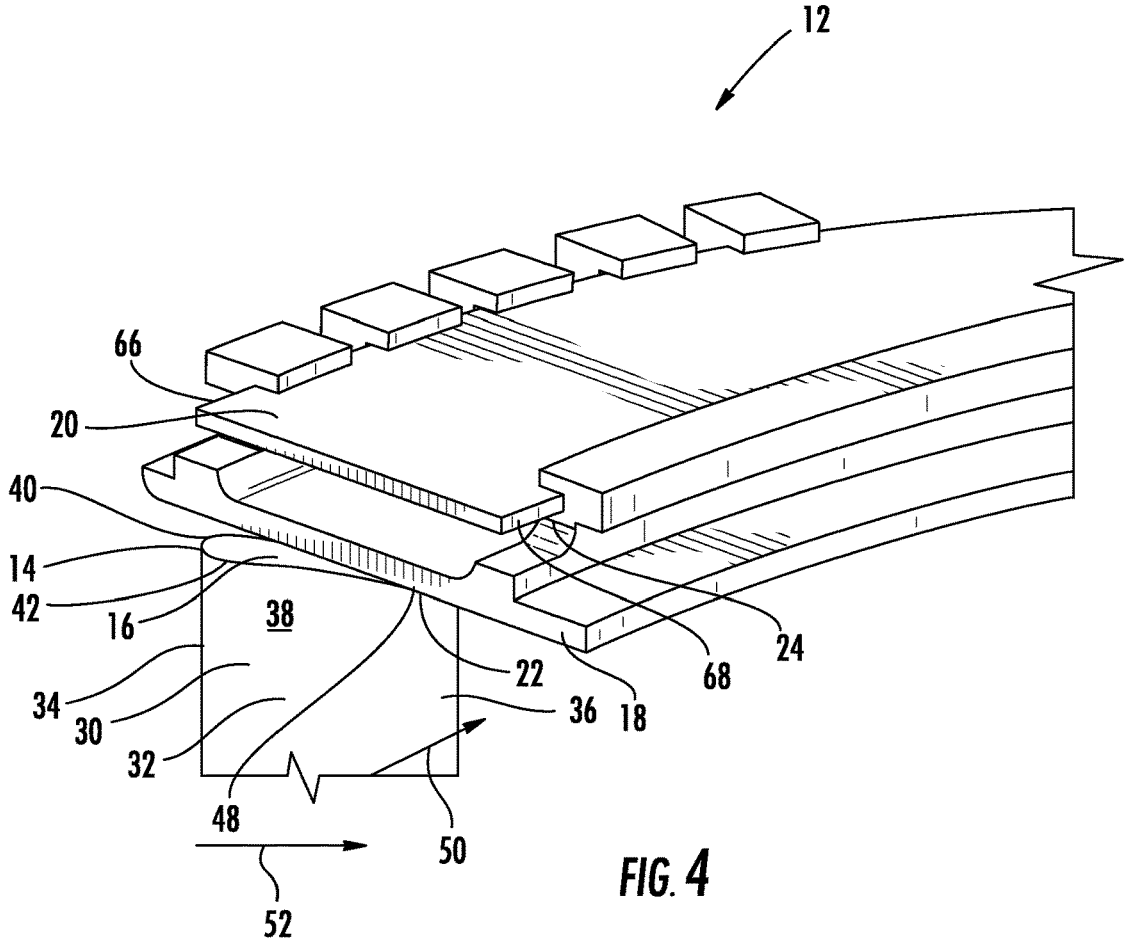
FIG. 4 is a perspective view of ring segments of the turbine assembly together with the clearance control band.

In at least one embodiment, as shown in FIGS. 1 and 4, the gas turbine engine 10 may be formed from a turbine assembly 26 formed from a rotor assembly 28 having one or more turbine blades 30 formed from a generally elongated airfoil 32 having a leading edge 34, a trailing edge 36, a pressure side 38, a suction side 40, a tip 16 at a first end 42 and a platform 44 coupled to a second end 46 of the generally elongated airfoil 32 opposite to the first end 42. A plurality of ring segments 18 may be positioned radially outward from the tip 16 of the turbine blade 30. The plurality of ring segments 18 may be aligned in a circumferentially extending row 48 and form a ring around a travel path 50 of the turbine blade 30. Each of the ring segments 18 may include an inner surface 22 forming a portion of a hot gas path 52 within the turbine assembly 26.

Figure 2:
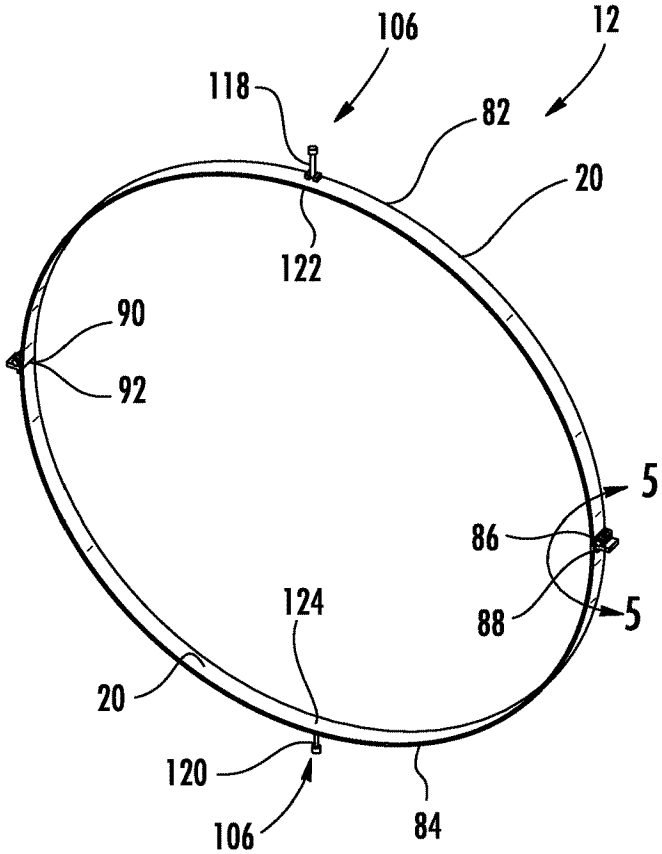
FIG. 2 is a perspective view of clearance control band of the turbine blade tip clearance control system.
Figure 3:
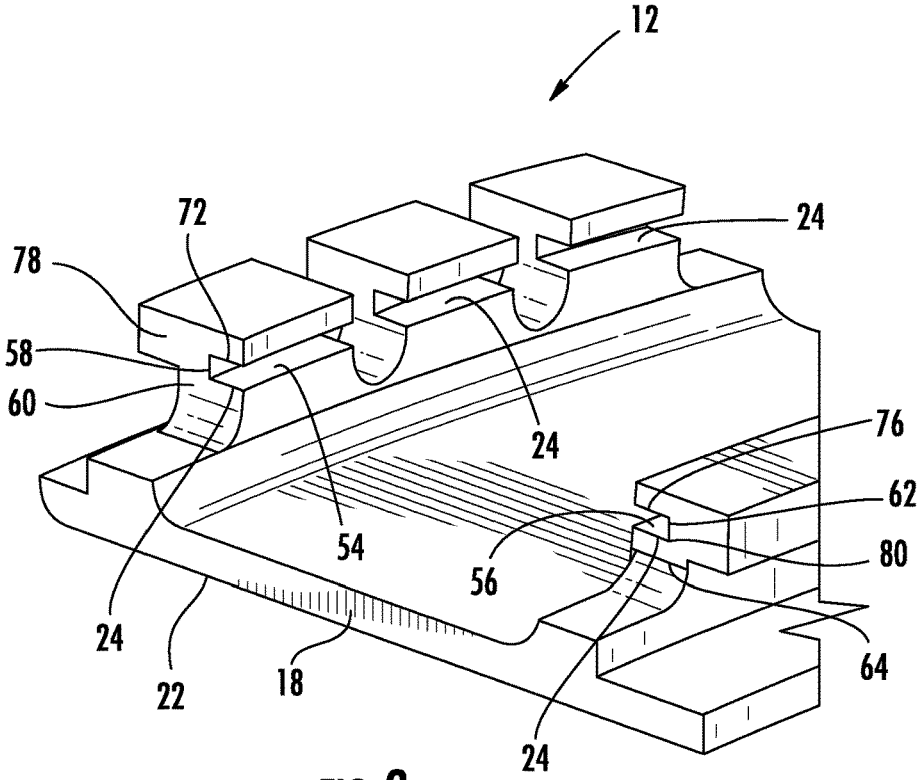
FIG. 3 is a perspective view of a ring segment of the turbine assembly of the gas turbine engine, whereby the ring segment has been adapted to partially contain the clearance control band.

The gas turbine engine 10 may include one or more clearance control bands 20 positioned radially outward of the inner surfaces 22 of the ring segments 18 and bearing against one or more outer surfaces 24 of the ring segments 18, as shown in FIGS. 3 and 4, to limit radial movement of the ring segments 18. The clearance control band 20, as shown in FIG. 2, may form a ring radially outward of the inner surface 22 of the ring segments 18. In at least one embodiment, the clearance control band 20 may have a coefficient of thermal expansion that differs from a coefficient of thermal expansion of a material forming one or more ring segments 18. In at least one embodiment, the clearance control band 20 may have a lower coefficient of thermal expansion than a material forming one or more ring segments 18. In at least one embodiment, the clearance control band 20 may be formed from materials including, but not limited to, IN909 and other appropriate materials. The clearance control band 20 may be formed from a thin strip having a thickness less than 1.5 inches. In another embodiment, the clearance control band 20 may be formed from a thin strip having a thickness less than 0.5 inches. In another embodiment, the clearance control band 20 may be formed from a thin strip having a thickness less than 0.125 inches. A width of the clearance control band 20 in an axial direction may be between about 40 millimeters and about 200 millimeters. In at least one embodiment, the width of the clearance control band 20 in the axial direction may be between about 90 millimeters. A ratio of the width to thickness of the clearance control band 20 may be, but is not limited to being, between about 5 to 1 and about 300 to 1.

As shown in FIGS. 3 and 4, the plurality of ring segments 18 may include an upstream bearing surface 54 and a downstream bearing surface 56 configured to engage the clearance control band 20. One or more of the ring segments 18 may include a first upstream receiver channel 58 positioned on an upstream aspect 60 of the ring segment 18 and a first downstream receiver channel 62 positioned on a downstream aspect 64 of the ring segment 18. An upstream edge 66 of the clearance control band 20 may be contained within the first upstream receiver channel 58, and a downstream edge 68 of the clearance control band 20 may be contained within the first downstream receiver channel 62. The first upstream receiver channel 58 may be formed from an upstream bearing surface 54 and an upstream outer containment surface 72. The first downstream receiver channel 62 may be formed from a downstream bearing surface 56 and a downstream outer containment surface 76. The clearance control system 12 may include one or more upstream support arms 78 extending radially outward from one or more ring segments 18 and one or more downstream support arms 80 extending radially outward from one or more ring segments 18. The upstream support arm 78 may house the first upstream receiver channel 58, and the downstream support arm 80 may house the first downstream receiver channel 62.

Figure 6:
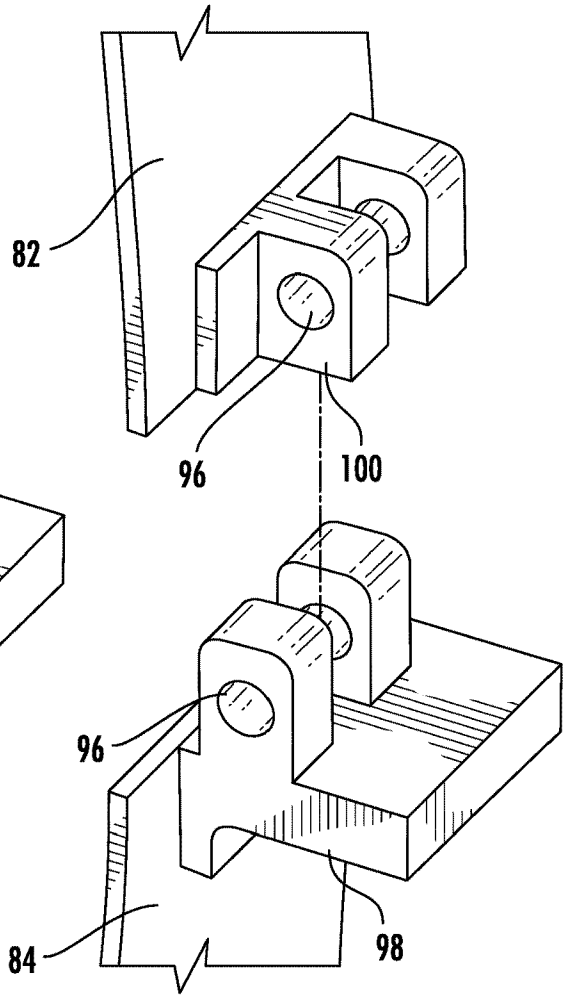
FIG. 6 is an exploded view of the connection of the upper and lower halves forming the clearance control band shown in FIG. 5.
Figure 5:
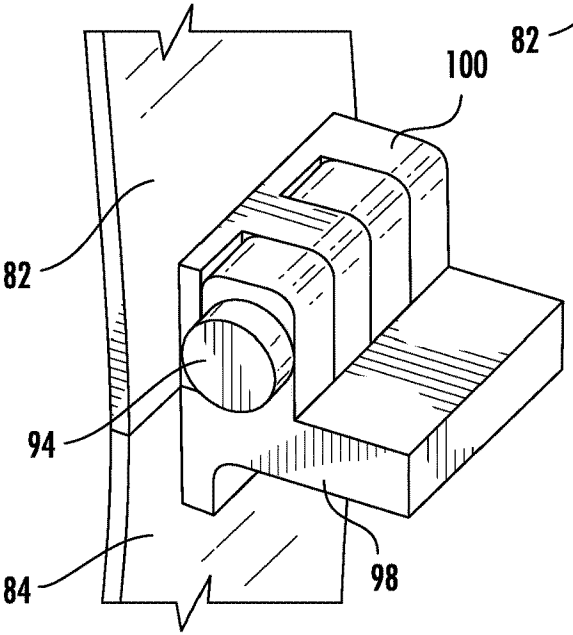
FIG. 5 is a detail, perspective view of a connection of the upper and lower halves forming the clearance control band, taken at detail line 5-5 in FIG. 3.
Figure 9:
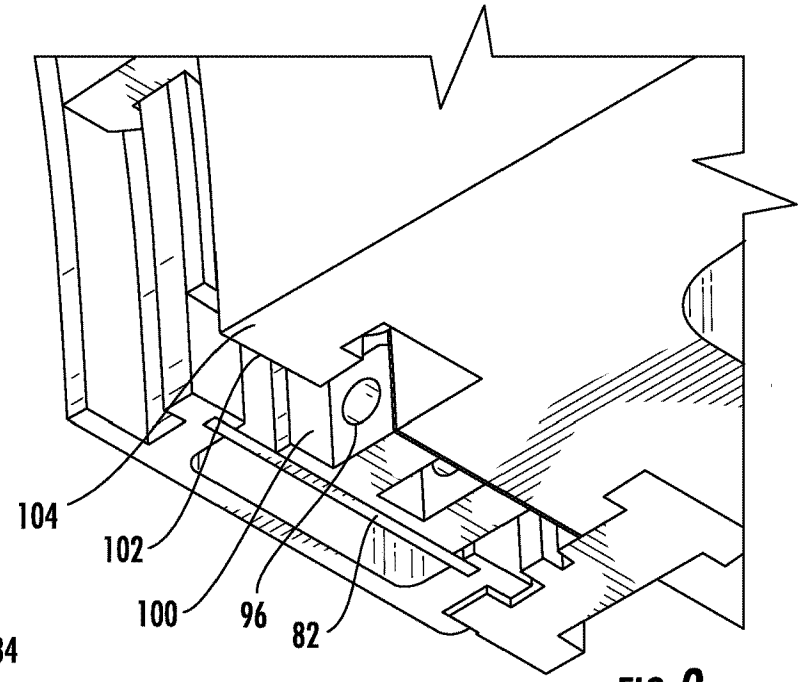
FIG. 9 is a partial perspective view of the connection of the upper half forming the clearance control band positioned within a pocket of a turbine component shown in FIGS. 5 and 7.
Figure 7:
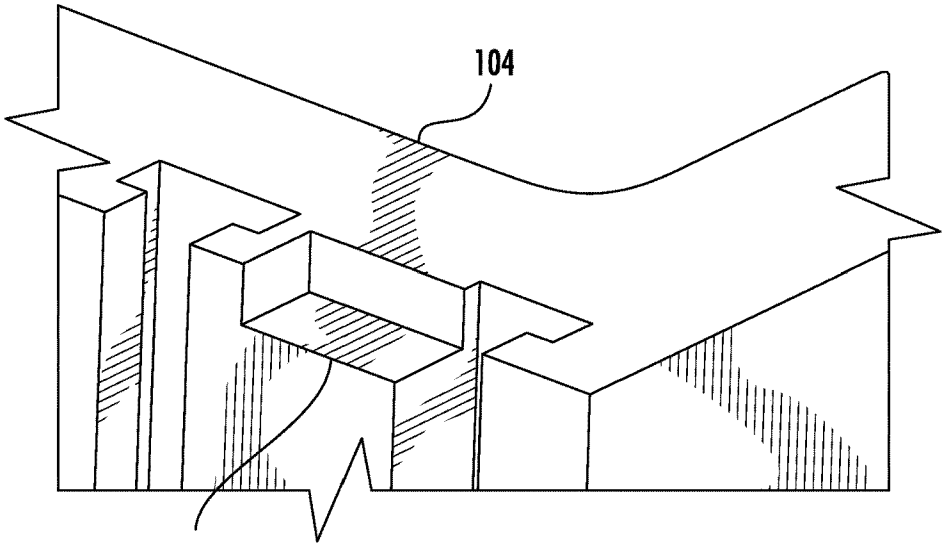
FIG. 7 is a partial perspective view of a turbine component with a pocket for receiving the connection of the upper and lower halves forming the clearance control band shown in FIG. 5.
Figure 8:
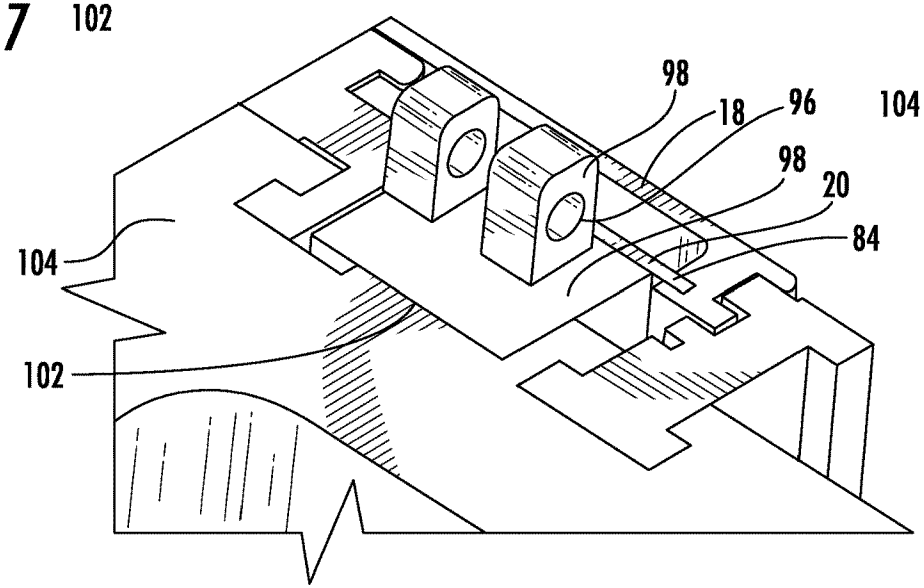
FIG. 8 is a partial perspective view of the connection of the lower half forming the clearance control band positioned within a pocket of a turbine component shown in FIGS. 5 and 7.

In at least one embodiment, as shown in FIG. 2, the clearance control band 20 may be formed from an upper half 82 and a lower half 84. As shown in FIGS. 2, 5 and 6, the upper and lower halves 82, 84 of the clearance control band 80 may be coupled together at a first intersection 86 at a first horizontally positioned joint 88 and may be coupled together at a second intersection 90 at a second horizontally positioned joint 92. Either of the first and second joints 88, 92, or both, may be coupled together via one or more locking pins 94 extending through an orifice 96 in a first joint connection block 98 and an orifice 96 in a second joint connection block 100. As shown in FIGS. 7-9, the first joint connection block 98 may be positioned within a pocket 102 in a turbine component 104 positioned radially outward of the ring segments 18 and the clearance control band 20. The pocket 102 may prevent circumferential movement of the first joint connection block 98. Similarly, the second joint connection block 100 may be positioned within a pocket 102 in a turbine component 104 positioned radially outward of the ring segments 18 and the clearance control band 20. The pocket 102 prevents circumferential movement of the second joint connection block 100.

Figure 10:
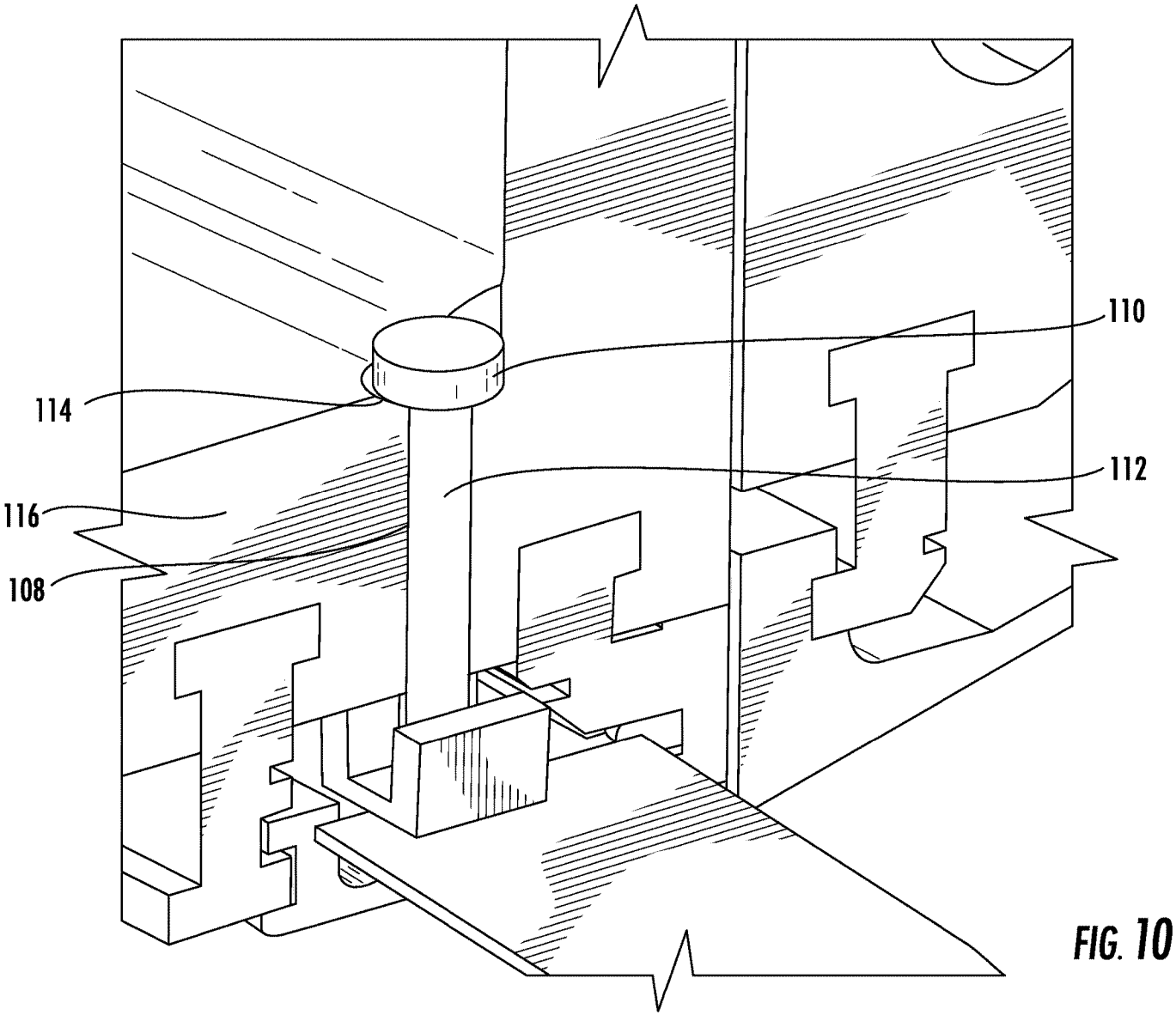
FIG. 10 is a partial perspective view of a movement limiter extending radially outward from the clearance control band.

As shown in FIGS. 2 and 10, the clearance control system 12 may also include a movement limiter 106 extending radially outward from the clearance control band 20. The movement limiter 106 may be formed from one or more pins 108 extending radially outward from the clearance control band 20. A head 110 of the pin 108 may have a larger cross-sectional area than a body 112 of the pin and may be positioned radially outward from the body 112. The head 110 may be secured by a bearing surface 114 on an adjacent turbine component 116. The movement limiter 106 may include an upper movement limiter 118 to secure the upper half 82 the clearance control band 20 and a lower movement limiter 120 to secure a lower half 84 the clearance control band 20. The upper movement limiter 118 may be positioned in a top dead center position 122, and the lower movement limiter 120 may be positioned in a bottom dead center position 124.

Figure 11:
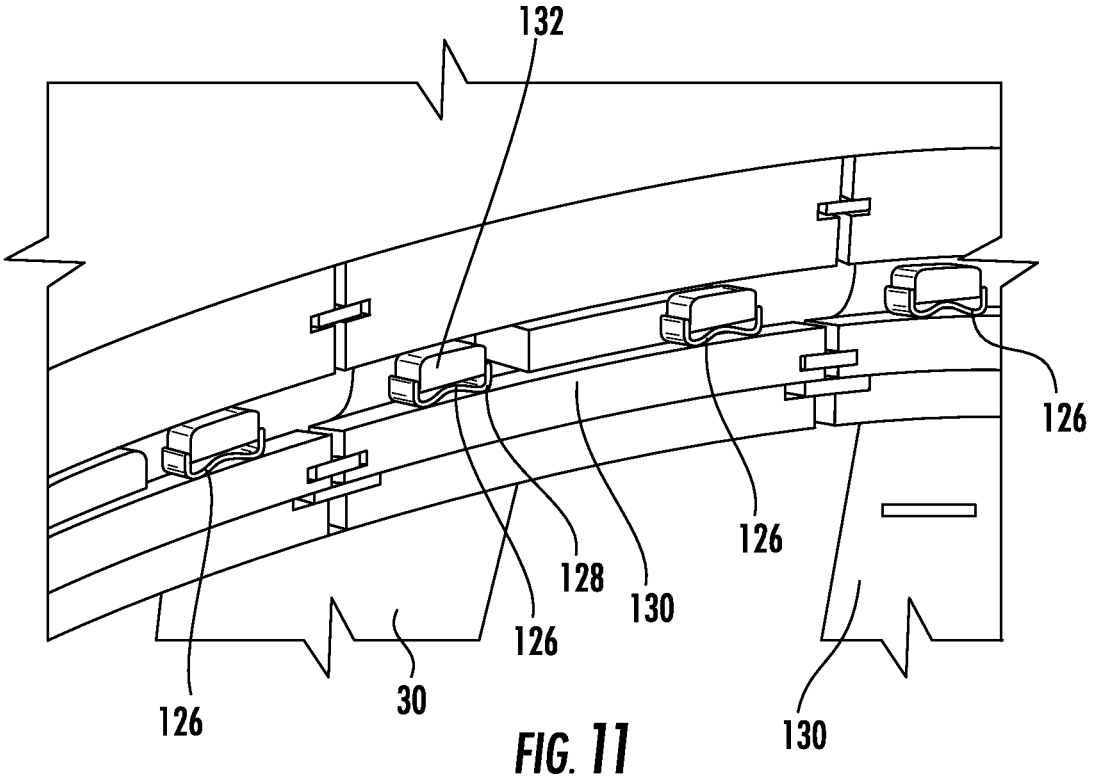
FIG. 11 is a partial perspective view of a plurality of side wave springs that may bias the ring segments radially outward to avoid an elliptical ring segment shape from forming during transient start-up and shutdown of the turbine engine.
Figure 12:
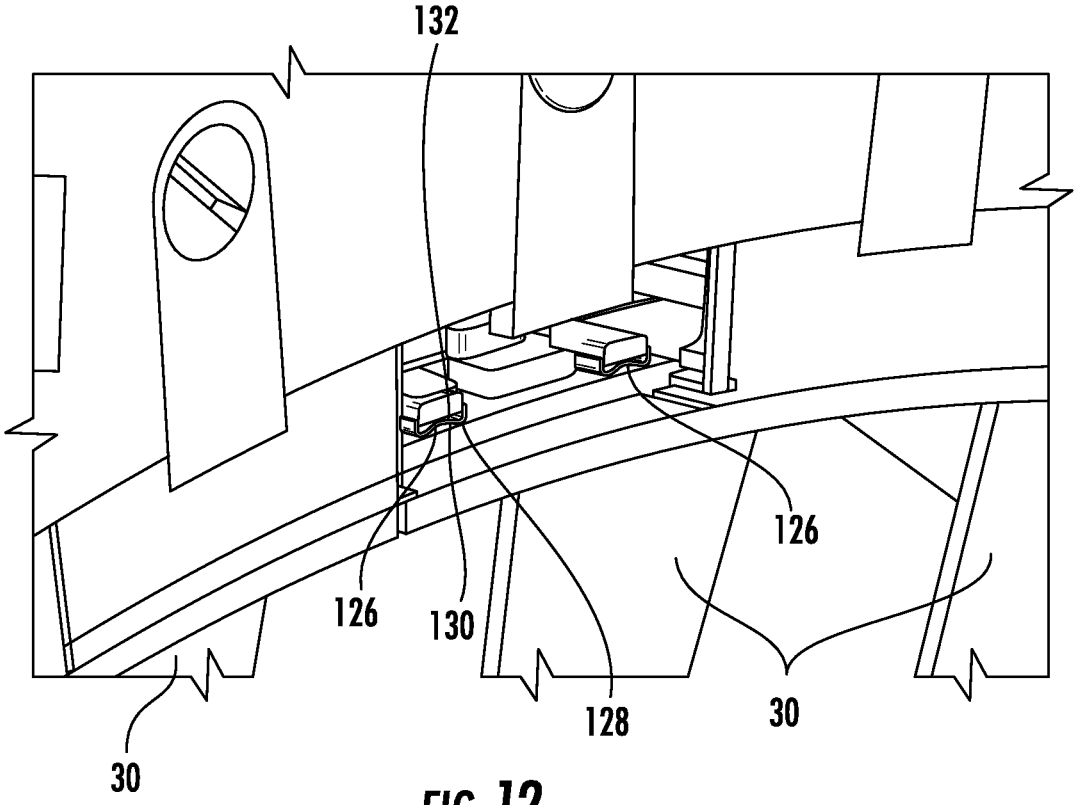
FIG. 12 is another partial perspective view of a plurality of side wave springs that may bias the ring segments radially outward to avoid an elliptical ring segment shape from forming during transient start-up and shutdown of the turbine engine.
Figure 13:
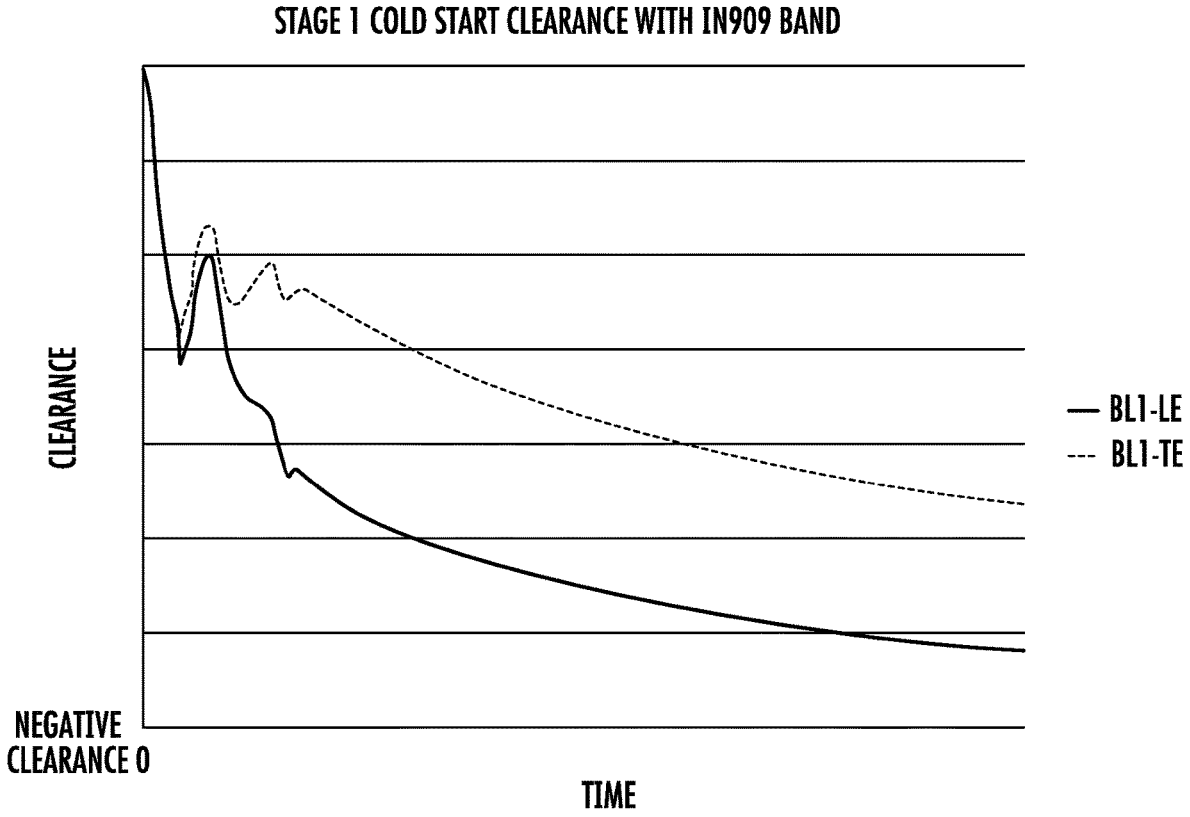
FIG. 13 is a graph of the clearance between a turbine blade tip and an inner surface of a ring segment immediately outward of the turbine blade tip as the blade and ring segment respond to thermal growth through a start-up process of the turbine engine.

As shown in FIGS. 11 and 12, the clearance control system 12 may also include one or more side wave springs 126 that may bias the ring segments 18 radially outward to avoid an elliptical ring segment shape from forming during transient start-up and shutdown of the turbine engine 10. The side wave spring 126 may also be used to damping elements for possible flow path vibration. In at least one embodiment, the side wave spring 126 may be positioned between a radially outward facing surface 128 of a turbine vane carrier 130 and a radially inward facing surface 132 of a ring segment 18. The side wave spring 126 may be positioned on an upstream side or a downstream side of the ring segment 18, or both. In at least one embodiment, a plurality of side wave springs 126 may be positioned on the upstream and downstream sides of the ring segments 18.

During use, the turbine 10 may be brought from through a start-up transient conditions to steady state operation. During operation, the clearance control band 20 limits radial movement of the ring segments 18 and does not have a pinch point where the gap 14 is the smallest at a point during start-up transient conditions, as shown in FIG. 13. Instead, the smallest gap 14 occurs during steady state operating conditions. In at least one embodiment, the clearance control band 20 of the clearance control system 12 can be configured to set the gap 14 between turbine blade tips 16 and radially outward ring segments 18 at steady state operation to zero to substantially eliminate, if not complete eliminate, leakage of hot combustion gases through the gap 14 via the elimination of the gap 14. Eliminating the leakage of hot combustion gases through the gap 14 increases the efficiency of the turbine assembly 26 and the gas turbine engine 10.

The foregoing is provided for purposes of illustrating, explaining, and describing embodiments of this invention. Modifications and adaptations to these embodiments will be apparent to those skilled in the art and may be made without departing from the scope or spirit of this invention.

We claim:

1. A gas turbine engine comprising:

a turbine assembly formed from a rotor assembly having at least one turbine blade formed from a generally elongated airfoil having a leading edge, a trailing edge, a pressure side, a suction side, a tip at a first end and a platform coupled to a second end of the generally elongated airfoil opposite to the first end;

a ring segment positioned radially outward from the tip of the at least one turbine blade, wherein the ring segment is aligned in a circumferentially extending row forming a ring around a travel path of the at least one turbine blade and wherein the ring segment includes an inner surface forming a portion of a hot gas path within the turbine assembly;

at least one clearance control band configured as a strip and positioned radially outward of the inner surface of the ring segment and bearing against an outer surface of the ring segment to limit radial movement of the ring segment;

wherein the at least one clearance control band forms a ring radially outward of the inner surface of the ring segment, wherein the ring segment is a single piece, wherein a first upstream receiver channel is positioned on an upstream aspect of the ring segment and extends radially outward from the outer surface of the ring segment to contain an upstream edge of the at least one clearance control band, wherein a first downstream receiver channel is positioned on a downstream aspect of the ring segment and extends radially outward from the outer surface of the ring segment to contain a downstream edge of the at least one clearance control band, wherein the at least one clearance control band has a lower coefficient of thermal expansion than a material forming the ring segment, wherein the at least one clearance control band is formed from an upper half and a lower half, wherein an upper pin extends radially outward from the upper half clearance control band and is positioned at a top dead center position to secure the upper half clearance control band, and wherein a lower pin extends radially outward from the lower half clearance control band and is positioned at a bottom dead center position to secure the lower half clearance control band.

2. The gas turbine engine of claim 1, wherein the ring segment includes an upstream bearing surface and a downstream bearing surface configured to engage the at least one clearance control band.

3. The gas turbine engine of claim 1, wherein the first upstream receiver channel is formed from an upstream bearing surface and an upstream outer containment surface, and wherein the first downstream receiver channel is formed from a downstream bearing surface and a downstream outer containment surface.

4. The gas turbine engine of claim 3, wherein at least one upstream support arm extending radially outward from the ring segment and at least one downstream support arm extends radially outward from the ring segment, wherein the at least one upstream support arm houses the first upstream receiver channel and the at least one downstream support arm houses the first downstream receiver channel.

5. The gas turbine engine of claim 1, wherein the upper and lower halves of the at least one clearance control band are coupled together at a first intersection at a first horizontally positioned joint and are coupled together at a second intersection at a second horizontally positioned joint.

6. The gas turbine engine of claim 5, wherein at least one of the first and second joints are coupled together via at least one locking pin extending through an orifice in a first joint connection block and an orifice in a second joint connection block.

7. The gas turbine engine of claim 1, wherein each of the upper and lower pins comprises a head and a body, and wherein the head has a larger cross-sectional area than the body and is positioned radially outward from the body and is secured by a bearing surface on an adjacent turbine component.

8. The gas turbine engine of claim 1, further comprising a side wave spring positioned between a radially outward facing surface of a turbine vane carrier and a radially inward facing surface of the ring segment, the side wave spring being configured to bias the ring segment radially outward.

* * * * *